US008794684B2

(12) United States Patent
Angelle et al.

(10) Patent No.: US 8,794,684 B2
(45) Date of Patent: Aug. 5, 2014

(54) EXTENDED RANGE SINGLE-JOINT ELEVATOR

(75) Inventors: Jeremy Richard Angelle, Lafayette, LA (US); John Erick Stelly, Breaux Bridge, LA (US); Tyler J. Hollier, Broussard, LA (US)

(73) Assignee: Frank's International, LLC, Houston, TX (US)

( * ) Notice: Subject to any disclaimer, the term of this patent is extended or adjusted under 35 U.S.C. 154(b) by 142 days.

(21) Appl. No.: 13/459,340

(22) Filed: Apr. 30, 2012

(65) Prior Publication Data

US 2012/0326459 A1 Dec. 27, 2012

Related U.S. Application Data

(60) Provisional application No. 61/481,218, filed on May 1, 2011.

(51) Int. Cl.
*B66C 1/48* (2006.01)
*E21B 19/07* (2006.01)

(52) U.S. Cl.
USPC ..... 294/102.2; 188/67

(58) Field of Classification Search
USPC ..... 294/102.2, 102.1, 86.19, 86.2, 86.26, 294/86.28, 86.3, 90, 116; 188/67
See application file for complete search history.

(56) References Cited

U.S. PATENT DOCUMENTS

| | | | | |
|---|---|---|---|---|
| 4,275,488 | A | 6/1981 | Gray et al. | |
| 4,354,706 | A * | 10/1982 | Coyle, Sr. | 294/102.2 |
| 5,992,801 | A * | 11/1999 | Torres | 248/49 |
| 6,494,273 | B1 | 12/2002 | Martin | |
| 6,571,667 | B2 * | 6/2003 | Price et al. | 81/57.33 |
| 7,681,649 | B2 * | 3/2010 | Cerovsek | 166/382 |
| 7,762,343 | B2 * | 7/2010 | Sonneveld et al. | 166/382 |
| 2010/0200221 | A1 | 8/2010 | Sipos | |

OTHER PUBLICATIONS

International Search Report and Written Opinion from PCT/US2012/035752 dated Nov. 28, 2012 (8 pages).
International Preliminary Report on Patentability issued in PCT/US2012/035752 mailed Nov. 14, 2013 (5 pages).

* cited by examiner

*Primary Examiner* — Paul T Chin
(74) *Attorney, Agent, or Firm* — Osha Liang LLP

(57) ABSTRACT

An oilfield elevator is disclosed and has first and second body halves pivotally-coupled at a hinge and moveable between an open position and a closed position to receive and move a tubular segment. Slips are slidably received within corresponding tapered slots in the elevator and are configured to translate vertically within the tapered slots and, at the same time, radially so as to be able to capture a wider range of tubular having varied outside diameters. Tension handles are pivotally-coupled to the first and second body halves and moveable between locked and unlocked positions. Locking the tension handles engages the slips via biasing members, and forces the slips into radial contact with the tubular segment. Unlocking the tension handles releases the biasing members.

20 Claims, 4 Drawing Sheets

EXTENDED RANGE SINGLE-JOINT ELEVATOR

This application claims priority to U.S. Provisional Patent Application Ser. No. 61/481,218, which was filed May 1, 2011. This priority application is hereby incorporated by reference in its entirety into the present application, to the extent that it is not inconsistent with the present application.

BACKGROUND

In the oil and gas industry, wellbores are drilled into the Earth using drilling rigs, where tubulars are threaded together to form long tubular strings that are inserted into the wellbore to extract the desired fluid. The tubular string is generally suspended in the borehole using a rig floor-mounted spider, such that each new tubular segment or stand may be threaded onto the end of the previous tubular just above the spider. A single-joint elevator is commonly used to grip and secure the segment or stand to a hoist to lift the segment or stand into position for threading the tubular together.

For installing a string of casing, single-joint elevators generally include a pair of hinged body halves that open to receive a tubular segment and subsequently close to secure the tubular segment within the elevator. Single-joint elevators are specifically adapted for securing and lifting tubular segments having a conventional connection, such as an internally-threaded sleeve that receives and secures an externally-threaded end from each of two tubular segments to secure the segments in a generally abutting relationship. The internally-threaded sleeve is first threaded onto the end of a first tubular segment to form a "box end." The externally-threaded "pin end" of a second tubular segment is then threaded into the box end to complete the connection between the two segments. When the elevator is in the closed position, i.e., when the hinged body halves are secured shut, the internal diameter of the elevator is less than the outer diameter of the box end. Consequently, the circumferential shoulder formed by the elevator engages the tubular segment at a corresponding shoulder formed by the end of the sleeve, thereby preventing the tubular segment from slipping through the elevator.

At least one challenge encountered by typical single-joint elevators is that they are designed to catch a very small range (e.g., outside diameter) of casing. With numerous integral and upset connections currently being used in the field, there are often times variances in the outside diameter of the box end of the casing that prohibit the use of a solitary single-joint elevator. Instead, two or more single-joint elevators are required to accommodate the varying outside diameters of the pipes and/or connections encountered.

What is needed, therefore, is a multi-range, single-joint elevator capable of being secured to tubulars having a range of deviations in the outside diameter thereof.

SUMMARY

Embodiments of the disclosure may provide an oilfield elevator. The elevator may include first and second body halves pivotally-coupled at a hinge and moveable between an open position and a closed position, and one or more slips slidably received within one or more corresponding downwardly-tapered slots defined in respective inner circumferential surfaces of the first and second body halves, the one or more slips being configured to translate vertically within the one or more tapered slots and, at the same time, translate radially with respect to the first and second body halves. The elevator may also include first and second timing bars coupled to the one or more slips, and first and second tension handles pivotally-coupled to the first and second body halves, respectively, and moveable between a locked position and an unlocked position, the first and second tension handles each having a body that terminates at a connection point. The elevator may further include first and second biasing members each having a first end coupled to the connection point of the first and second tension handles, respectively, and a second end coupled to the first and second timing bars, respectively, wherein the first and second biasing members impart a downward force on the one or more slips via the first and second timing bars when the first and second handles are in the locked position, and wherein the first and second biasing members reduce the downward force on the one or more slips via the first and second timing bars when the first and second handles are in the unlocked position.

Embodiments of the disclosure may further provide a method for engaging a tubular segment. The method may include positioning an elevator adjacent the tubular segment, the elevator including first and second body halves having slips slidably received within corresponding tapered slots defined in the first and second body halves, wherein a first timing bar is coupled to the slips in the first body half and a second timing bar is coupled to the slips in the second body half, and closing the first and second body halves around the tubular segment. The method may further include moving first and second tension handles from an unlocked position to a locked position, the first and second tension handles being pivotally-coupled to the first and second body halves, respectively, and each tension handle having a body that terminates at a connection point, and applying a downward force on the first and second timing bars with first and second biasing members having a first end coupled to the connection point of the first and second tension handles, respectively, and a second end coupled to the first and second timing bars, respectively. The method may also include transmitting the downward force from the first and second timing bars to the slips, the slips being configured to translate vertically within the tapered slots and, at the same time, translate radially with respect to the first and second body halves in response to the downward force, wherein the slips translate vertically and radially until coming into contact with an outside surface of the tubular segment.

Embodiments of the disclosure may further provide an apparatus for engaging a tubular segment. The apparatus may include first and second body halves pivotally-coupled at a hinge and moveable between an open position and a closed position, one or more slips slidably received within downwardly and inwardly-tapered slots defined in the first and second body halves, the one or more slips being configured to translate within the tapered slots, and first and second timing bars coupled to the one or more slips. The apparatus may also include first and second tension handles pivotally-coupled to the first and second body halves, respectively, and moveable between a locked position and an unlocked position, each tension handle having a body that is coupled to a connection point, and first and second biasing members, each having a first end coupled to the connection point of the first and second tension handles, respectively, and a second end coupled to the first and second timing bars, respectively, the first and second biasing members being configured to impart a downward force on the first and second timing bars when the first and second handles are in the locked position, thereby forcing the one or more slips to translate within the tapered slots until coming into contact with the outside surface of the tubular segment.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
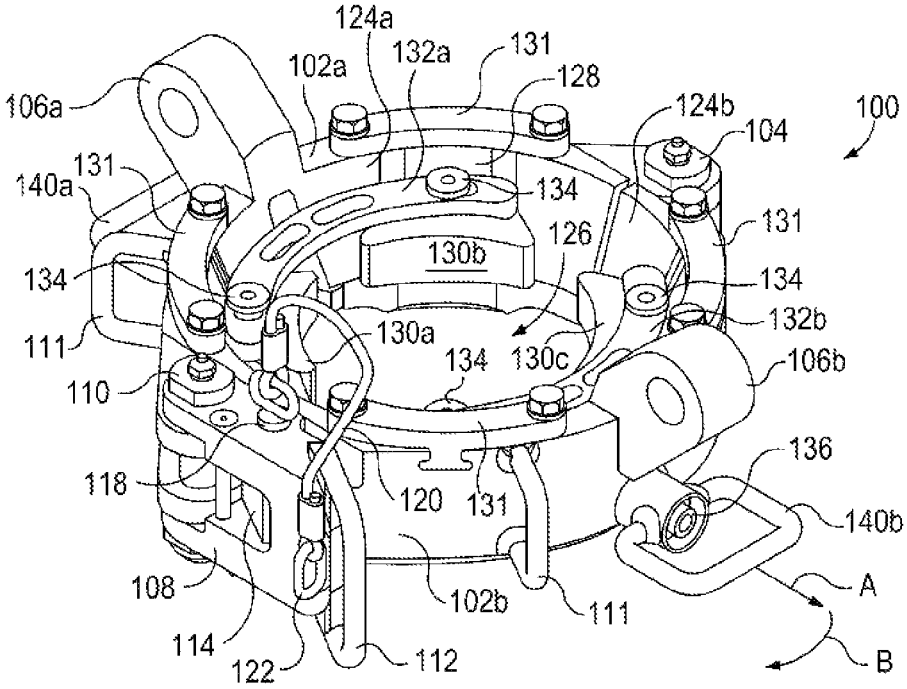
FIG. 1 illustrates an isometric view of an exemplary elevator, according to one or more embodiments of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
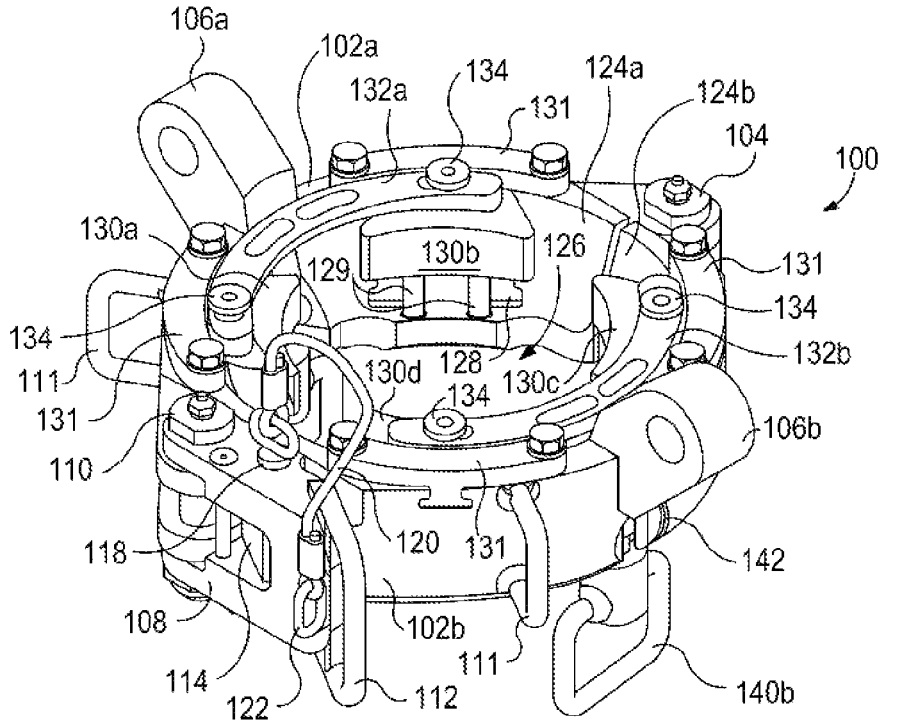
FIG. 2 illustrates an isometric view of the elevator of FIG. 1 with tension handles in the unlocked position, according to one or more embodiments of the disclosure.
Figure 3:
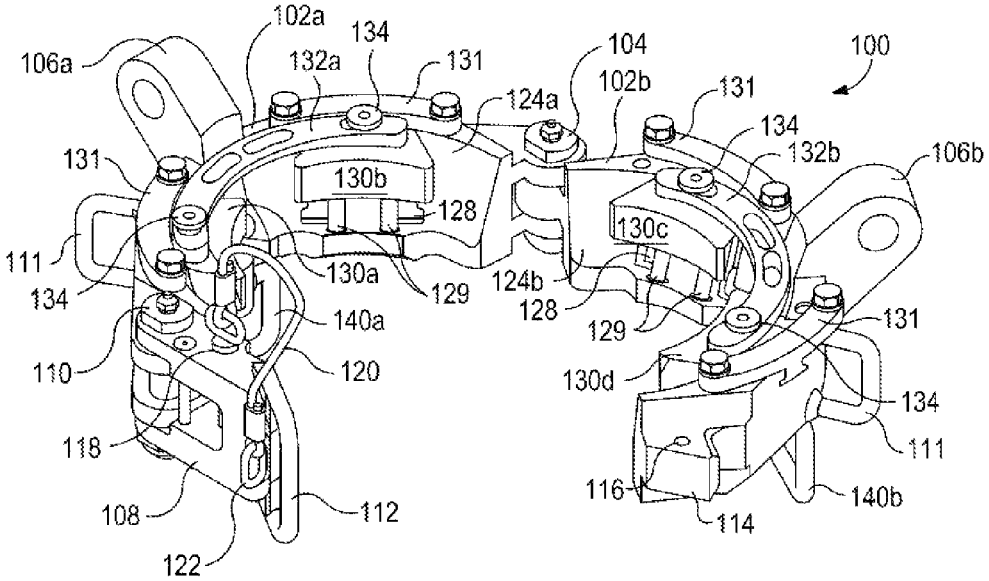
FIG. 3 illustrates an isometric view of the elevator of FIG. 1 in an open position, according to one or more embodiments of the disclosure.

FIGS. 1-3 illustrate an exemplary oilfield elevator 100, according to one or more embodiments disclosed. The elevator 100 is moveable between a closed position, as shown in FIGS. 1 and 2, and an open position, as shown in FIG. 3. In one embodiment, the elevator 100 may be a single-joint elevator configured to grasp onto and position a singular tubular segment, such as a drill pipe or casing, for coupling to a tubular string. The elevator 100 may include a first body half 102*a* and a second body half 102*b* pivotally connected at a hinge 104. Each body half 102*a,b* may have a lifting ear 106*a* and 106*b*, respectively, integrally formed therewith or connected thereto and configured to be coupled to or otherwise receive links (not shown) in order to position the elevator 100 during tubular makeup operations.

The elevator 100 is moveable between the open and closed positions by pivoting each body half 102*a,b* about the axis of the hinge 104. To help accommodate this movement, one or more positioning handles 111 may be attached to the exterior of the first and second halves 102*a,b* to be grasped by a user to manipulate their general position. In other embodiments, the positioning handles 111 may be omitted and an automated opening/closing system (not shown) may be implemented to mechanically open/close the elevator 100. For example, the elevator 100 may be opened/closed using mechanical devices such as hydraulics, servos, gearing, etc., without departing from the scope of the disclosure.

The elevator 100 may be secured in the closed position with a locking apparatus 108 pivotally-coupled to the first body half 102*a* with a pivotal coupling 110. In other embodiments, the locking apparatus 108 may be pivotally coupled to the second body half 102*b*, without departing from the scope of the disclosure. In one embodiment, the pivotal coupling 110 may be spring loaded. A locking handle 112 projects from the locking apparatus 108 and may be grasped by a user to manually bring the first body half 102*a* into proximity of the second body half 102*b*. Once the first and second body halves 102*a,b* are proximally aligned, the locking mechanism 108 may be configured to extend over a latch 114 (best seen in FIG. 3) integrally-formed with the second body half 102*b*. The latch 114 may define a perforation 116 (FIG. 3) adapted to receive a pin 118 (partially shown). The pin 118 may be extendable through corresponding perforations (not shown) defined in the locking mechanism 108 and into the perforation 116 to secure the locking mechanism 108 in the closed position. As illustrated, the pin 118 may be attached to a cord or cable 120 that is anchored to the locking mechanism 108 at an anchor point 122.

The first and second body halves 102*a* and 102*b* each define an inner circumferential surface 124*a* and 124*b*, respectively. When the elevator 100 is in the closed position, the inner circumferential surfaces 124*a,b* cooperatively define a generally circular opening or throat 126 that may be configured to receive and secure a tubular or casing segment. The inner circumferential surfaces 124*a,b* may further define a series of tapered slots 128; one slot is 128 shown in FIGS. 1 and 2, and two slots 128 are shown in FIG. 3. The term "tapered" as used herein refers to the slots 120 being inclined to the axis of the throat 126, such as being downwardly and inwardly-tapered with respect to the axis of the throat 126.

The tapered slots 128 may be equidistantly-spaced from each other about the inner circumferential surfaces 124*a,b*. In one embodiment, each inner circumferential surface 124*a,b* may define a total of two slots 128, but in other embodiments more or less than two slots 128 may be provided. Moreover, the number of slots 128 defined in either inner circumferential surface 124*a,b* does not necessarily have to be equal, but may vary depending on the application.

Each slot 128 may be adapted to slidably receive a slip 130, such as slips 130*a*, 130*b*, 130*c*, and 130*d* (only slips 130*a,b,c* are shown in FIG. 1). As illustrated, the slots 128 defined in the first inner circumferential surface 124*a* may slidably receive the first slip 130*a* and the second slip 130*b*, while the slots 128 defined in the second inner circumferential surface 124*b* may slidably receive the third slip 130*c* and the fourth slip 130*d*. Each slip 130*a-d* may be partially cylindrical and configured to engage the outside surface of a tubular segment, as will be described in more detail below.

During elevator 100 operation, the slips 130*a-d* may be able to translate vertically within their respective slots 128. To facilitate this vertical translation, each slot 128 may include one or more rails 129 (FIGS. 2 and 3) configured to seat a respective slip 130*a-d*. The rails 129 may be configured to extend through a portion of the respective slip 130*a-d*, thereby providing a fixed translation path for each slip 130*a-d*. In at least one embodiment, each rail 129 may be encompassed by a compression spring 152 (FIGS. 4 and 5) adapted to continuously bias the respective slip 130*a-d* upward and into an "open" position. In other embodiments, the compression springs 152 may be separate from the rails 129 but nonetheless work in concert therewith to facilitate the vertical translation of the slips 130*a-d*.

Each slip 130*a-d* may be maintained within its respective slot 128 using a retainer plate 131 fastened to the first or second body halves 102*a,b* adjacent the upper end of each slot 128. The retainer plates 131 may be fastened to the first or second body halves 102*a,b* by any known method including, but not limited to, mechanical fasteners.

A first timing bar 132*a* may be used to moveably couple the first slip 130*a* to the second slip 130*b*, such that when the first slip 130*a* moves, the second slip 130*b* moves as well, and vice versa. A second timing bar 132*b* may be used to moveably couple the third slip 130*c* to the fourth slip 130*d* such that when the third slip 130*c* moves, the fourth slip 130*d* moves as well, and vice versa. One or more mechanical fasteners 134 (e.g., bolts, screws, etc.) may be used to secure the timing bars 132*a,b* to the respective slips 130*a-d*. In other embodiments, however, the timing bars 132*a,b* may be attached to the respective slips 130*a-d* via other attachments, such as welding, brazing, adhesives, or combinations thereof, without departing from the scope of the disclosure.

The elevator 100 may further include first and second tension handles 140*a* and 140*b* pivotally coupled to the first and second body halves 102*a* and 102*b*, respectively. FIG. 1 shows the tension handles 140*a,b* in a "locked" position, and FIGS. 2 and 3 show the tension handles 140*a,b* in an "unlocked" position. In the locked position, each tension handle 140*a,b* may rest or otherwise be seated within a recessed pocket 141 (FIG. 2) defined in the outer circumferential surface of each body half 102*a,b*, respectively. Moreover, each tension handle 140*a,b* may include a spring-loaded body fixture 136 (FIG. 1) adapted to bias the tension handle 140*a,b* into its respective recessed pocket 141.

To unlock the tension handles 140*a,b*, a user may pull radially-outward on the tension handle 140*b* (or 140*a*), as indicated by arrow A in FIG. 1, to remove it from the recessed pocket 141. Once removed from the recessed pocket 141, the tension handle 140*b* may swivel downward and back toward the body half 140*b*, as indicated by arrow B. Locking the tension handles 140*a,b* back in place within the recessed pockets 141 can be accomplished by a reversal of the above-described steps.

Figure 4:
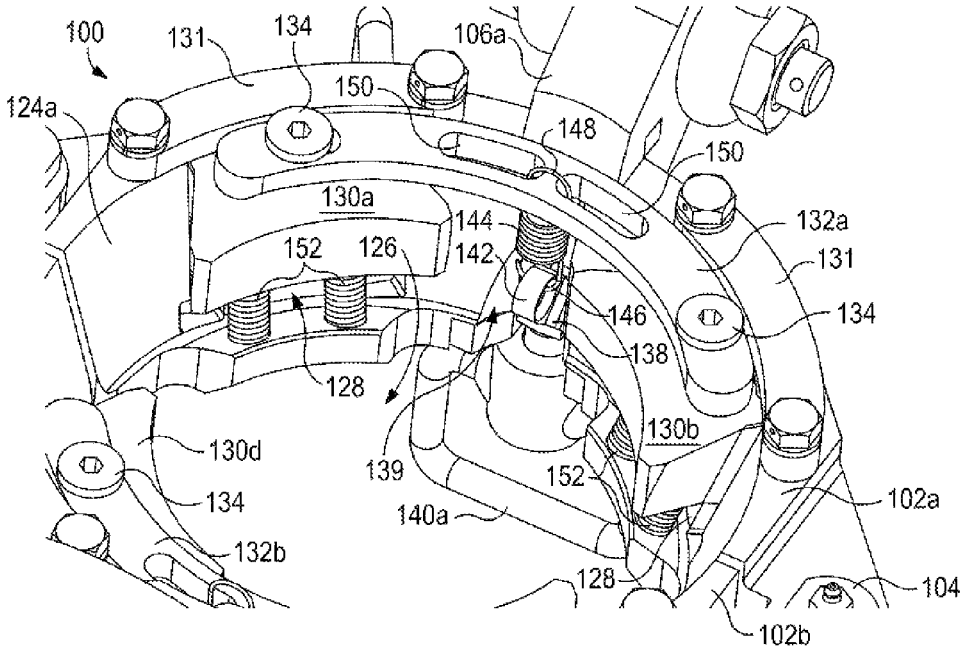
FIG. 4 illustrates a close-up view of a throat of the elevator of FIG. 1, with the tension handle in the unlocked position, according to one or more embodiments of the disclosure.
Figure 5:
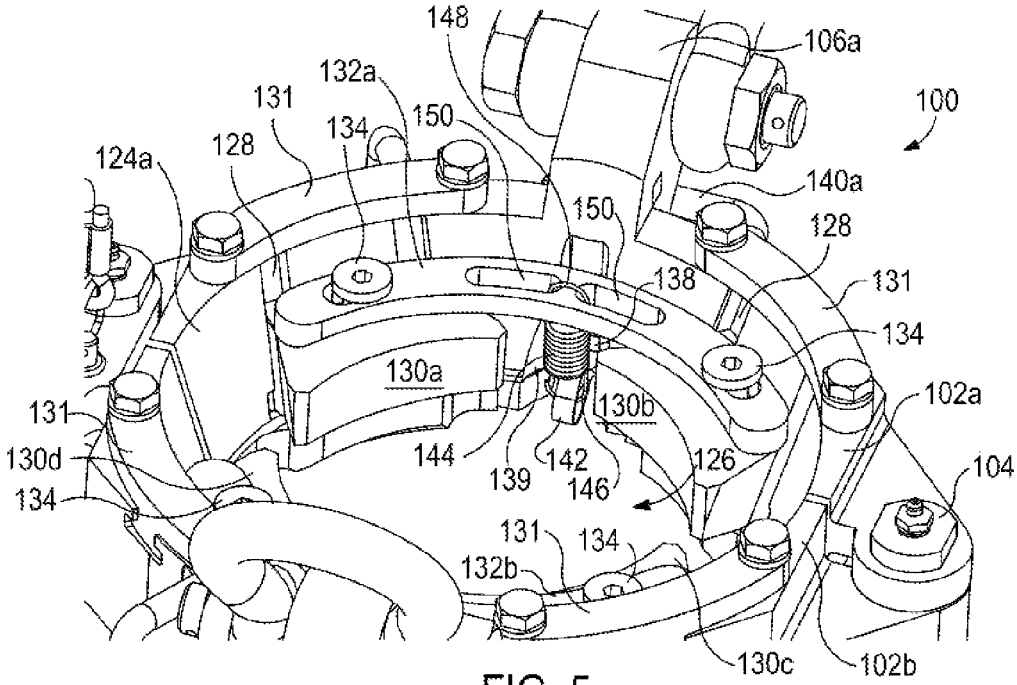
FIG. 5 illustrates a close-up view of the throat of the elevator of FIG. 1, with the tension handle in the locked position, according to one or more embodiments of the disclosure.

Referring now to FIGS. 4 and 5, with continuing reference to FIGS. 1-3, illustrated are isometric views of the elevator 100 with the tension handles 140*a,b* in the unlocked (FIG. 4) and locked (FIG. 5) positions, according to one or more embodiments of the disclosure. Although only the first body half 102*a*, including the first tension handle 140*a*, is shown in FIGS. 4 and 5 and described below, it will be appreciated that the following description is equally applicable to the components of the second body half 102*b*, especially including the second tension handle 140*b*, but will not be discussed herein for the sake of brevity.

As illustrated, the first tension handle 140*a* may include a body 138 that extends generally into the throat 126 through an opening 139 defined in the first body half 102*a*. The opening 139 may generally extend from the outer surface of the first body half 102*a* to the inner circumferential surface 124*a*. The body 138 may terminate at a connection point 142 configured to be coupled to a biasing member 144, for example, at a first end 146 of the biasing member 144. In one embodiment, the biasing member 144 may be a tension spring, as illustrated. In other embodiments, however, the biasing member 144 may be any other device capable of providing a biasing force such as, but not limited to, pneumatic devices, hydraulic devices, servo devices, electromagnets, or combinations thereof.

In the illustrated embodiment, the connection point 142 includes a ring structure, but in other embodiments the connection point 142 may include any other type of structure capable of being coupled to the biasing member 144. The biasing member 144 may also include a second end 148 configured to be coupled to the first timing bar 132*a*. In one embodiment, the first timing bar 132*a* may define one or more holes 150 for receiving or otherwise securing the second end 148 of the biasing member 144. It will be appreciated, however, that the second end 148 may be secured to the first timing bar 132*a* in any known manner, without departing from the scope of the disclosure.

When the first tension handle 140*a* is in the unlocked position (FIG. 4), the biasing member 144 is able to retract, at least partially, and thereby reduce the downward force exhibited on the first timing bar 132*a*. As the downward force on the timing bar 132*a* is removed or otherwise diminished, the compression springs 152 are able to expand and force the first and second slips 130*a,b* vertically-upward and into the open position within their respective slots 128. Since the slots 128 are inclined to the axis of the throat 126, upward axial movement of the slips 130*a,b* simultaneously results in a radial movement of the slips 130*a,b* away from the center of the throat 126. Consequently, in the open position the slips 130*a,b* provide the largest throat 126 area.

When the first tension handle 140*a* is returned to its locked position (FIG. 5), the connection point 142 pulls down on and engages the biasing member 144 which transmits a generally downward force on the first timing bar 132*a*. As a result, the first timing bar 132*a* conveys a generally downward force on the first and second slips 130*a,b* and their accompanying compression springs 152, thereby causing the axial downward movement of the slips 130*a,b*. Moreover, because of the tapered disposition of the slots 128, downward axial movement of the slips 130*a,b* simultaneously results in a radial movement of the slips 130*a,b* toward the center of the throat 126. Consequently, in the closed position the slips 130*a,b* present the smallest throat 126 area for the elevator 100.

Figure 6:
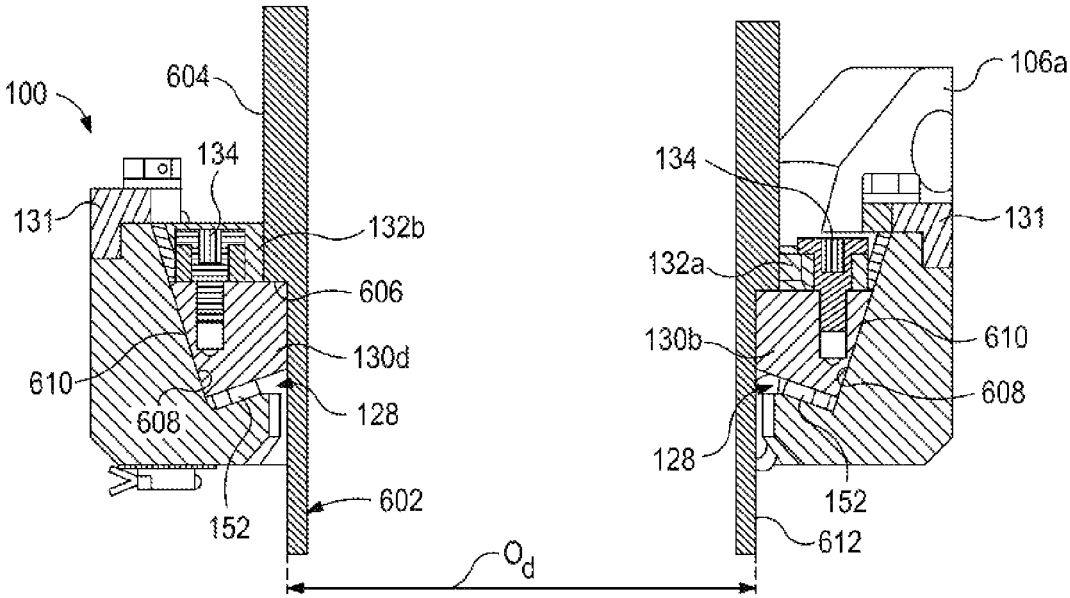
FIG. 6 illustrates a cross-sectional view of an exemplary elevator grasping a tubular segment, according to one or more embodiments of the disclosure.

Referring to FIG. 6, illustrated is a cross-sectional view of the exemplary elevator 100 as it engages a casing or tubular segment 602, according to one or more embodiments. In one embodiment, the tubular segment 602 may include a sleeve 604 coupled thereto. In other embodiments, the sleeve 604 may be a collar or other upset that is integrally-formed with the tubular segment 602. The sleeve 604 may include a circumferential shoulder 606 adapted to engage the elevator 100 at each slip 130*a-d* (only the second and third slips 130*b* and 130*d* are shown in FIG. 6).

The slips 130*a-d* may engage the tapered surface 608 of the respective slot 128 with a corresponding inclined surface 610. Via this sloping engagement between the tapered surface 608 and the inclined surface 610, the radial movement of the slips 130*a-d* toward or away from the center of the elevator 100 is realized. Consequently, the collective radial circumference of the slips 130*a-d* is able to increase and/or decrease over a fixed range, thereby manipulating the radius of the throat 126 and enabling the elevator 100 to receive and properly secure tubular segments 602 having a varied and increased range of an outside diameter $O_d$. As will be appreciated, this may be achieved without requiring any adjustment to or replacement of the elevator 100.

With the elevator 100 in the open position, as shown in FIG. 3, the tubular segment 602 may enter the throat 126. Once the elevator 100 is closed, the tension handles 140*a,b* (FIGS. 1-3) may be moved into the locked position, as shown in FIG. 5. Moving the tension handles 140*a,b* into the locked position applies a spring force on the slips 130*a-d* that results in the axial-downward and radial-inward movement of the slips 130*a-d*. As illustrated in FIG. 6, the second and third slips 130*b,d* will move axially-downward and radially-inward until eventually engaging the outside surface 612 of the tubular segment 602. The weight of the tubular segment 602 may shift the tubular segment 602 vertically until the circumferential shoulder 606 engages the slips 130*b,d*, thereby impeding its further downward progress. Via this sloping engagement between the tapered surface 608 and the inclined surface 610 of each slip 130*b,d*, any increased force in the downward direction against the slips 130*b,d* only tightens the engagement with the slips 130*b,d* on the outside diameter $O_d$ of the tubular segment 602.

Once the tubular segment 602 is properly coupled to a tubular string or otherwise securely captured by another lifting mechanism, the tension handles 140*a,b* may be unlocked in preparation for receiving a new tubular segment 602. Unlocking the tension handles 140*a,b* releases the spring forces on the slips 130*a-d* and allows the slips 130*a-d* to move axially-upward and into the open position, thereby releasing the tubular segment 602 from engagement with the elevator 100.

Figure 7:
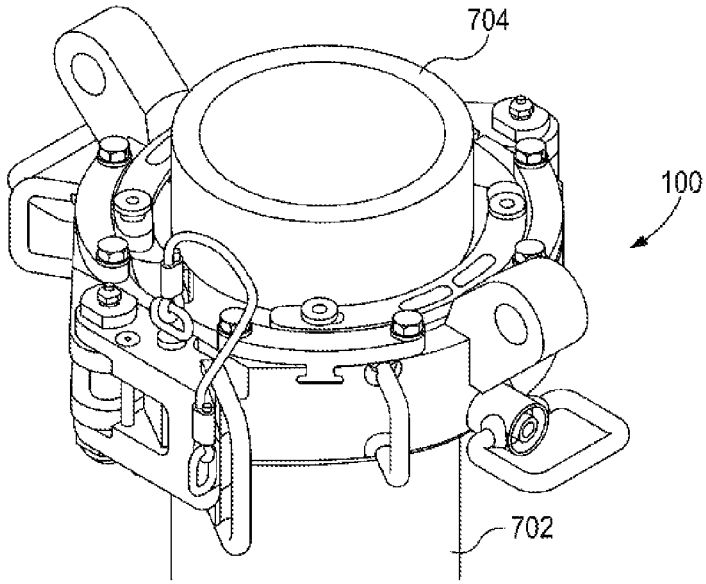
FIG. 7 illustrates an isometric view of an exemplary elevator grasping a tubular segment, according to one or more embodiments of the disclosure.

Referring to FIG. 7, illustrated is an isometric view of the exemplary oilfield elevator 100 engaged with a tubular segment 702, according to one or more embodiments disclosed. As described above, the elevator may be engaged to the tubular segment 702 at a sleeve 704. Those skilled in the art will recognize the several advantages provided by the elevator 100. For example, the elevator 100 is able to securely grasp onto multiple outside diameters within a nominal tubular segment 702 size. As a result, significant savings in money and time may be gained that would otherwise be spent in removing and replacing the elevator 100 or adjusting the settings for different outside diameters.

As used herein, the term "single-joint elevator" is intended to distinguish the elevator from a string elevator that is used to support the weight of the entire pipe string. Rather, a "single-joint elevator" is used to grip and lift a tubular segment as is necessary to add or remove the tubular segment to or from a tubular string. Furthermore, a pipe or tubular "segment", as that term is used herein, is inclusive of either a single pipe or tubular joint or a stand made up of multiple joints of a pipe or other tubular that will be lifted as a unit. In the context of the present disclosure, a tubular segment does not include a tubular string that extends into the well.

Figure 8:
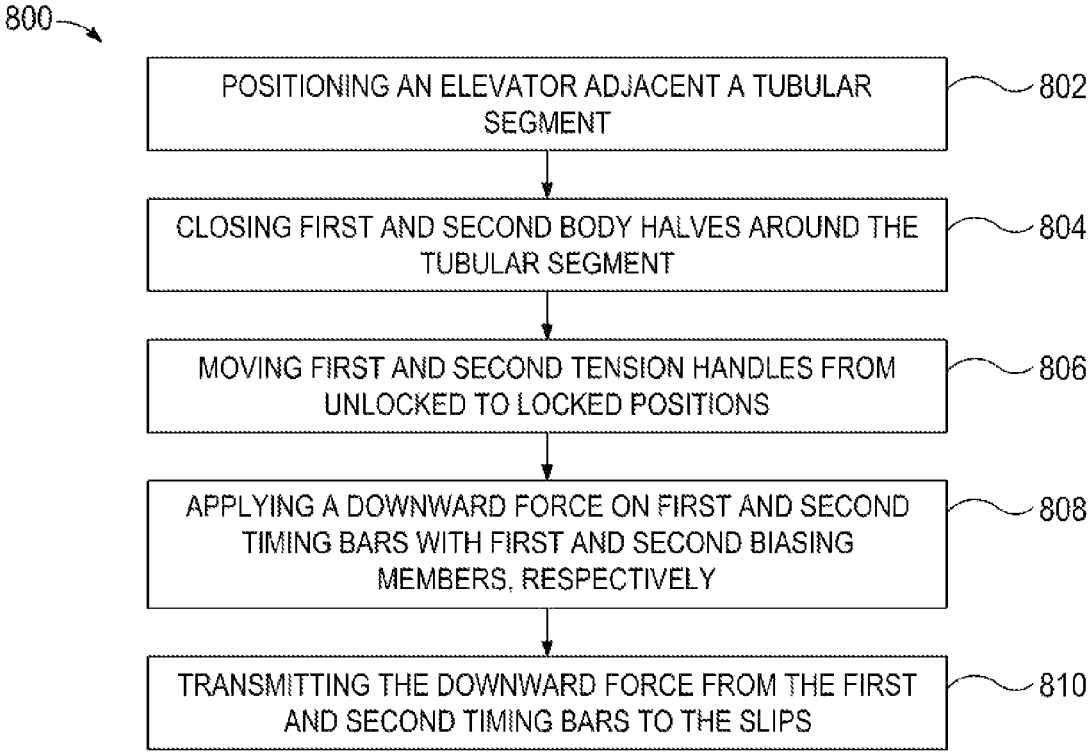
FIG. 8 is a flowchart of a method for engaging a tubular segment, according to one or more embodiments of the disclosure.

Referring now to FIG. 8, illustrated is a method 800 for engaging a tubular segment. In one embodiment, the method 800 may include positioning an elevator adjacent the tubular segment, as at 802. The elevator may include first and second body halves that have slips that are slidably received within corresponding tapered slots. The corresponding tapered slots may be defined in the first and second body halves. Moreover, a first timing bar may be coupled to the slips in the first body half and a second timing bar may be coupled to the slips in the second body half. The method 800 may further include closing the first and second body halves around the tubular segment, as at 804.

First and second tension handles may then be moved from an unlocked position to a locked position, as at 806. In one embodiment, the first and second tension handles may be pivotally-coupled to the first and second body halves, respectively, and each tension handle may have a body that terminates at a connection point. The method 800 may further include applying a downward force on the first and second timing bars with first and second biasing members, as at 808. The first and second biasing members may each have a first end coupled to the connection point of the first and second tension handles, respectively, and a second end coupled to the first and second timing bars, respectively. The downward force may then be transmitted from the first and second timing bars to the slips, as at 810. The slips may be configured to translate vertically within the tapered slots and at the same time translate radially with respect to the first and second body halves in response to the downward force. Accordingly, the slips may translate vertically and radially until coming into contact with an outside surface of the tubular segment.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. An oilfield elevator, comprising:

first and second body halves pivotally-coupled at a hinge and moveable between an open position and a closed position;

one or more slips slidably received within one or more corresponding downwardly-tapered slots defined in respective inner circumferential surfaces of the first and second body halves, the one or more slips being configured to translate vertically within the one or more tapered slots and, at the same time, translate radially with respect to the first and second body halves;

first and second timing bars coupled to the one or more slips;

first and second tension handles pivotally-coupled to the first and second body halves, respectively, and moveable between a locked position and an unlocked position, the first and second tension handles each having a body that terminates at a connection point; and first and second biasing members each having a first end coupled to the connection point of the first and second tension handles, respectively, and a second end coupled to the first and second timing bars, respectively, wherein the first and second biasing members impart a downward force on the one or more slips via the first and second timing bars when the first and second handles are in the locked position, and wherein the first and second biasing members reduce the downward force on the one or more slips via the first and second timing bars when the first and second handles are in the unlocked position.

2. The oilfield elevator of claim 1, further comprising a locking apparatus configured to secure the first and second body halves in the closed position.

3. The oilfield elevator of claim 1, further comprising retainer plates coupled to the first and second body halves at each of the tapered slots, the retainer plates being configured to maintain each of the one or more slips in the one or more tapered slots.

4. The oilfield elevator of claim 1, further comprising at least one rail disposed within each of the one or more tapered slots and configured to seat a respective one of the one or more slips for vertical translation.

5. The oilfield elevator of claim 4, further comprising at least one compression spring arranged within each of the one or more tapered slots and configured to bias the one or more slips upward at least partially within the one or more tapered slots.

6. The oilfield elevator of claim 5, wherein the at least one rail is at least partially disposed within the at least one compression spring arranged within each of the one or more tapered slots.

7. The oilfield elevator of claim 1, further comprising a recessed pocket defined in an outer circumferential surface of each of the first and second body halves and configured to receive and seat the first and second tension handles in the locked position.

8. The oilfield elevator of claim 1, wherein the connection point is a ring structure.

9. The oilfield elevator of claim 1, wherein at least one of the first and second biasing members is a tension spring.

10. A method for engaging a tubular segment, comprising:

positioning an elevator adjacent the tubular segment, the elevator including first and second body halves having slips slidably received within corresponding tapered slots defined in the first and second body halves, wherein a first timing bar is coupled to the slips in the first body half and a second timing bar is coupled to the slips in the second body half;

closing the first and second body halves around the tubular segment;

moving first and second tension handles from an unlocked position to a locked position, the first and second tension handles being pivotally-coupled to the first and second body halves, respectively, and each tension handle having a body that terminates at a connection point;

applying a downward force on the first and second timing bars with first and second biasing members having a first end coupled to the connection point of the first and second tension handles, respectively, and a second end coupled to the first and second timing bars, respectively; and transmitting the downward force from the first and second timing bars to the slips, the slips being configured to translate vertically within the tapered slots and, at the same time, translate radially with respect to the first and second body halves in response to the downward force, wherein the slips translate vertically and radially until coming into contact with an outside surface of the tubular segment.

11. The method of claim 10, further comprising:

moving the first and second tension handles from the locked position to the unlocked position;

removing the downward force on the first and second timing bars; and biasing the slips upward within the tapered slots with at least one compression spring disposed within each tapered slot.

12. The method of claim 10, further comprising securing the first and second body halves in the closed position with a locking apparatus.

13. The method of claim 10, further comprising maintaining each slip in its respective tapered slot with retainer plates coupled to the first and second body halves at each of the tapered slots.

14. The method of claim 10, further comprising seating the slips for vertical translation within each tapered slot with at least one rail disposed within each tapered slot.

15. The method of claim 14, further comprising biasing the slips upward with at least one compression spring disposed within each tapered slot.

16. An apparatus for engaging a tubular segment, comprising:

first and second body halves pivotally-coupled at a hinge and moveable between an open position and a closed position;

one or more slips slidably received within downwardly and inwardly-tapered slots defined in the first and second body halves, the one or more slips being configured to translate within the tapered slots;

first and second timing bars coupled to the one or more slips;

first and second tension handles pivotally-coupled to the first and second body halves, respectively, and moveable between a locked position and an unlocked position, each tension handle having a body that is coupled to a connection point; and first and second biasing members, each having a first end coupled to the connection point of the first and second tension handles, respectively, and a second end coupled to the first and second timing bars, respectively, the first and second biasing members being configured to impart a downward force on the first and second timing bars when the first and second handles are in the locked position, thereby forcing the one or more slips to translate within the tapered slots until coming into contact with the outside surface of the tubular segment.

17. The apparatus of claim 16, further comprising at least one rail disposed within each tapered slot and configured to seat a respective slip for vertical translation.

18. The apparatus of claim 17, further comprising at least one compression spring disposed within each tapered slot and configured to bias the one or more slips upward within the tapered slots.

19. The apparatus of claim 16, wherein each tapered slot has a tapered surface and each slip has a corresponding inclined surface to provide a sloping engagement between the tapered surface and corresponding inclined surface.

20. The apparatus of claim 19, wherein the sloping engagement allows the one or more slips to translate radially toward and away from a center of the apparatus as the slips translate vertically, thereby enabling the one or more slips to engage tubular segments of varied outside diameter.

* * * * *